US007823343B1

(12) United States Patent
Inzeo

(10) Patent No.: US 7,823,343 B1
(45) Date of Patent: Nov. 2, 2010

(54) CUSTOMIZABLE RIDGE VENTILATOR

(75) Inventor: Joseph A. Inzeo, West Allis, WI (US)

(73) Assignee: Metal-Era, Inc., Waukesha, WI (US)

( * ) Notice: Subject to any disclaimer, the term of this patent is extended or adjusted under 35 U.S.C. 154(b) by 220 days.

(21) Appl. No.: 11/839,105

(22) Filed: Aug. 15, 2007

Related U.S. Application Data

(60) Provisional application No. 60/878,771, filed on Jan. 5, 2007.

(51) Int. Cl.
*E04B 7/00* (2006.01)

(52) U.S. Cl. ..... 52/198; 52/199; 52/96; 52/60; 454/365

(58) Field of Classification Search ..... 52/199, 52/96, 198, 60–62; 454/365
See application file for complete search history.

(56) References Cited

U.S. PATENT DOCUMENTS 5,427,571 A 6/1995 Sells ..... 454/365
6,077,159 A * 6/2000 Clayton ..... 454/250
6,202,372 B1 * 3/2001 Powell ..... 52/198
6,240,690 B1 * 6/2001 James et al. ..... 52/302.3
6,662,509 B2 * 12/2003 Sharp et al. ..... 52/199
6,997,800 B1 * 2/2006 Kohler ..... 454/365

* cited by examiner

*Primary Examiner*—Richard E Chilcot, Jr.
*Assistant Examiner*—Anthony N Bartosik
(74) *Attorney, Agent, or Firm*—Donald J. Ersler

(57) ABSTRACT

A customizable ridge ventilator includes a first support bracket, a second support bracket, a perforated support and a ridge cover. The first and second support brackets are attached to a roof. The perforated support is secured to the first and second support brackets. The ridge cover is attached to the first support, the second support and the perforated support. A second embodiment includes a support bracket, a perforated support and a ridge cover. The support bracket is attached to a roof. The perforated support is attached to the support bracket and a back side of wall. The ridge cover is secured to the perforated support. A third embodiment includes a support bracket, a perforated support and a ridge cover. The support bracket is attached to a roof. The perforated support is attached to the support bracket. The ridge cover is attached to the perforated support bracket and a wall.

10 Claims, 14 Drawing Sheets

CUSTOMIZABLE RIDGE VENTILATOR

CROSS-REFERENCES TO RELATED APPLICATIONS

This is a utility patent application taking priority from provisional application No. 60/878,771 filed on Jan. 5, 2007.

BACKGROUND OF THE INVENTION

1. Field of the Invention

The present invention relates generally to roof ventilation and more specifically to a customizable ridge ventilator, which may be modified to accommodate different roof pitches and air flow requirements.

2. Discussion of the Prior Art

Proper ventilation of a roof prevents premature failure of roofing materials (such as shingles) due to excessive heat; moisture due to condensation, thus preventing a major source of mold and mildew; and ice damming in cold climates, which also leads to premature failure of roofing materials. Some of the factors that dictate ventilation requirements include roof size, attic space area, length of roof ridge, length of roof eaves, pitch of roof, the amount of insulation below the roof, exposure to sun, climate, humidity and temperature extremes.

There are numerous ridge ventilators in the art. U.S. Pat. No. 5,427,571 to Sells discloses a ventilated cap system for the ridge of a roof. The Sells patent includes an expandable utility cap to seal over a variably expanding metal roof. In one form, a top cap may snap lock over the utility cap for slidable attachment thereto when exposed to deforming forces such as ice or snow. The top cap prevents deformation of the underlying utility cap. However, the Sells ridge ventilator is not easily customizable.

Accordingly, there is a clearly felt need in the art for a customizable ridge ventilator, which may be easily modified to accommodate different ventilation factors.

SUMMARY OF THE INVENTION

The present invention provides a customizable ridge ventilator, which may be modified to accommodate different roof pitches and air flow requirements. The customizable ridge ventilator includes a first support bracket, a second support bracket, a perforated support and a ridge cover. The first support bracket has a substantially Z-shaped cross section. The second support bracket includes at least one base member and a support member. The first support bracket is attached to a first surface, adjacent one side of a ventilation opening and the base member of the second support bracket is placed on a second surface, adjacent the other side of the ventilation opening. The base member is structured to receive the support member. A roof membrane is placed over the base and support members.

The perforated support is a formed plate with a plurality of perforated openings. The perforated support preferably includes a cross section with a lengthwise section, a substantially vertical flange and a snap flange. The substantially vertical flange extends upward from one end of the lengthwise section and snap flange extends downward from the other end of the lengthwise section. The substantially vertical flange is secured to the support member and the roof membrane, and substantially a middle of the lengthwise section is secured to first support bracket.

The ridge cover includes a top portion, a sloped leg, an attachment leg, a snap clip and a drip extension. The sloped leg extends from a first side of the top portion and the attachment leg extends from the second side of the top portion. The sloped leg is terminated with the snap clip. The attachment leg is terminated with the drip extension. The attachment leg is slid over the roof membrane and the snap clip is slid over the snap flange of the perforated support. A cover splice includes a cross section that has the same shape as the ridge cover. The cover splice is sized to be received by an inner perimeter of the ridge cover. Two adjacent ridge covers are connected to each other with the cover splice.

A second embodiment of the customizable ridge ventilator includes a support bracket, a perforated support and a ridge cover. The support bracket has a substantially Z-shaped cross section. The first support bracket is attached to a first surface, adjacent one side of a ventilation opening. The perforated support is a formed plate with a plurality of perforated openings. The perforated support preferably includes a cross section with a top perforated portion, a dished perforated portion, a substantially vertical perforated portion, a first snap flange and a second snap flange. The dished perforated portion extends from one side of the top perforated portion and the substantially vertical perforated portion extends downward from the other side of the top perforated portion. The dished perforated portion is terminated with the first snap flange and the substantially vertical perforated portion is terminated with the second snap flange.

The ridge cover includes a top portion, a sloped portion, a substantially vertical portion, a first snap clip and a second snap clip. The sloped portion extends from one side of the top portion and the substantially vertical portion extends from the other side of the top portion. The sloped portion is terminated with the first snap clip and the substantially vertical portion is terminated with the second snap clip. The first snap clip is slid over the first snap flange and the second snap clip is slid over the second snap flange. A cover splice includes a cross section that has the same shape as the ridge cover. The cover splice is sized to be received by an inner perimeter of the ridge cover. Two adjacent ridge covers are connected to each other with the cover splice.

A third embodiment of the customizable ridge ventilator includes a support bracket, a perforated support and a ridge cover. The support bracket has a substantially Z-shaped cross section. The support bracket is attached to a surface, adjacent one side of a ventilation opening. The perforated support is a formed plate with a plurality of perforated openings. The perforated support preferably includes a cross section with a dished portion, a snap flange and a perforated attachment flange. One end of the dished portion is terminated with the snap flange and the other end of dished portion is terminated with the perforated attachment flange.

The ridge cover preferably includes a cross section with a sloped top portion, a snap clip and an attachment flange. One end of the top portion is terminated with the snap clip and the other end of sloped top portion is terminated with the attachment flange. The snap clip is slid over the snap flange and the attachment flange is laid over the perforated attachment flange. A cover splice includes a cross section that has substantially the same shape as the ridge cover. The cover splice is sized to be received by an inner perimeter of the ridge cover. Two adjacent ridge covers are connected to each other with the cover splice.

Accordingly, it is an object of the present invention to provide a customizable ridge ventilator, which may be easily modified to accommodate different ventilation factors.

These and additional objects, advantages, features and benefits of the present invention will become apparent from the following specification.

DETAILED DESCRIPTION OF THE PREFERRED EMBODIMENTS

Figure 1:
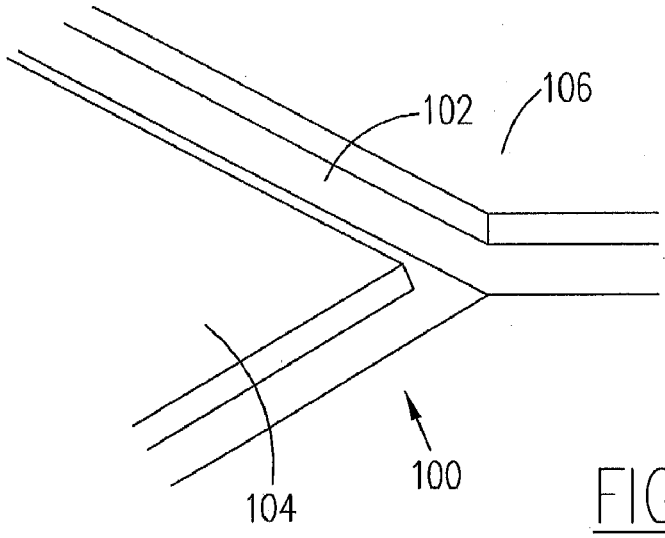
FIG. 1 is a perspective view of a roof with a ventilation opening for attachment of a customizable roof ventilator in accordance with the present invention.
Figure 2:
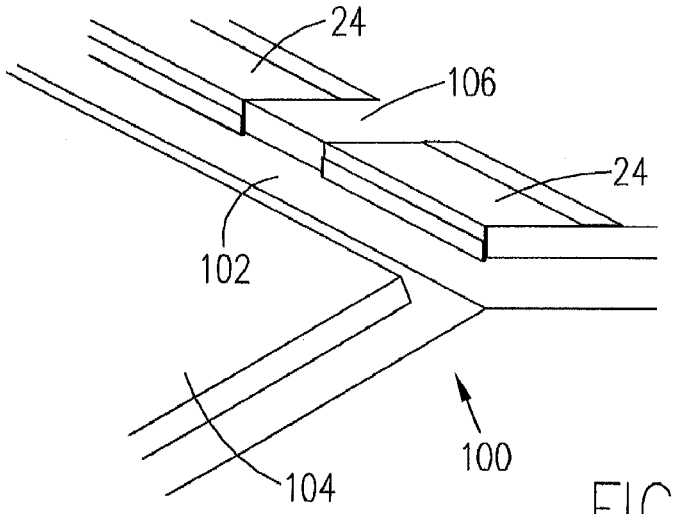
FIG. 2 is a perspective view of two base members positioned on a roof of a customizable roof ventilator in accordance with the present invention.
Figure 3:
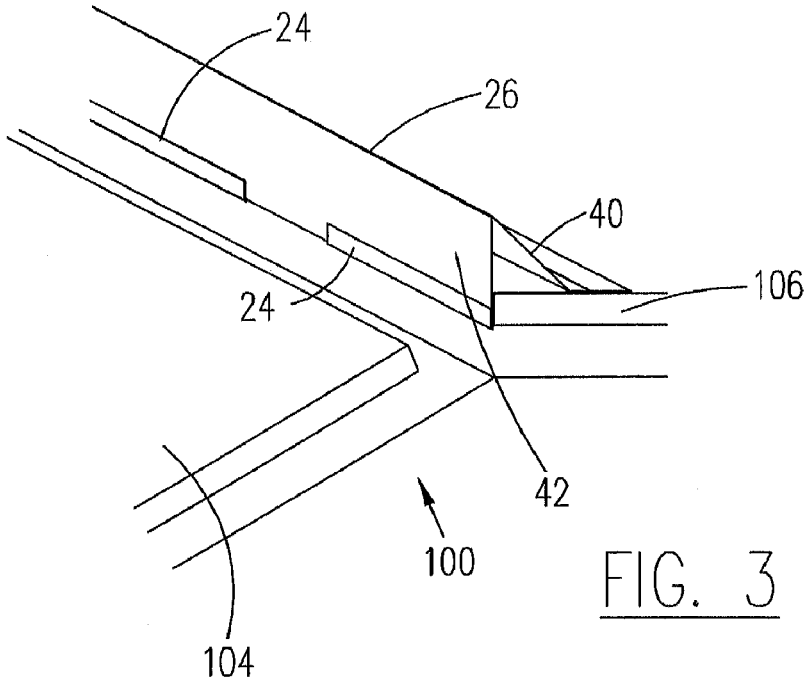
FIG. 3 is a perspective view of a support member retained by two base members of a customizable roof ventilator in accordance with the present invention.
Figure 4:
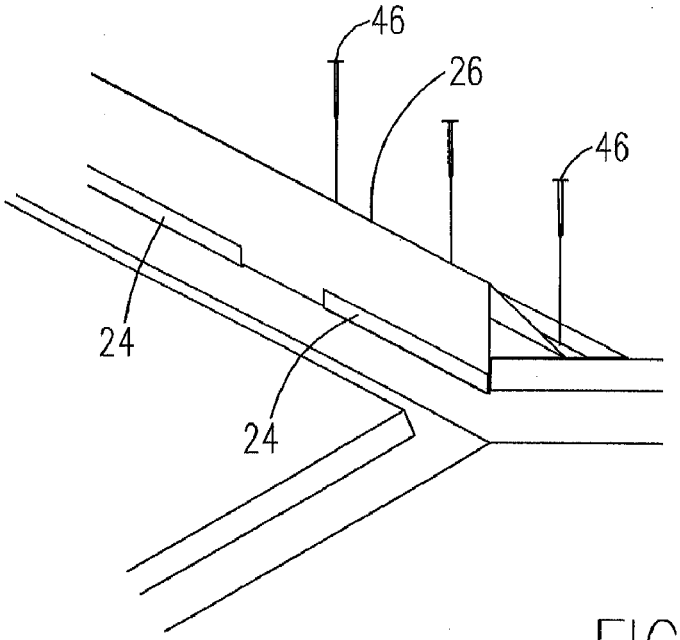
FIG. 4 is a perspective view of two base members and a support member, before attachment to a roof with a plurality of fasteners of a customizable roof ventilator in accordance with the present invention.
Figure 5:
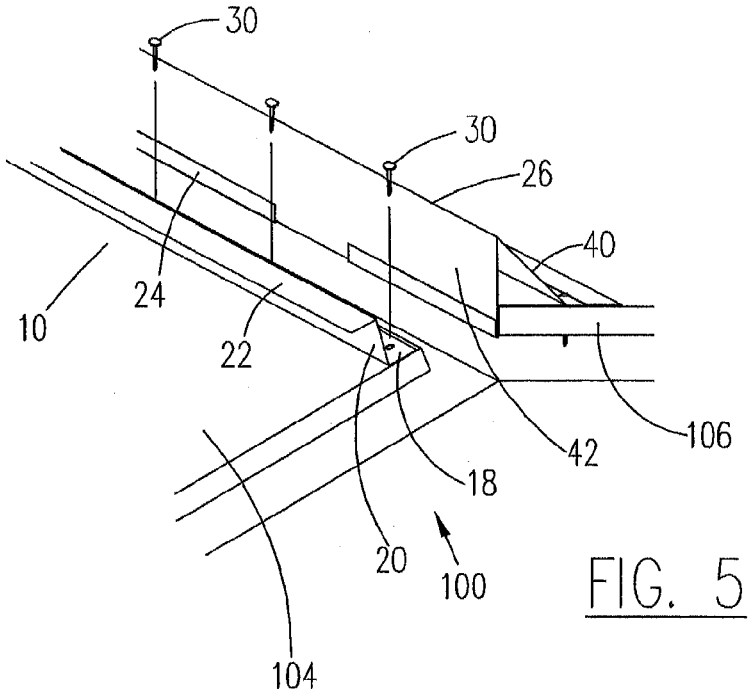
FIG. 5 is a perspective view of a two base members and a support member attached to a roof and a first support bracket positioned on the roof, before attachment with a plurality of fasteners of a customizable roof ventilator in accordance with the present invention.
Figure 6:
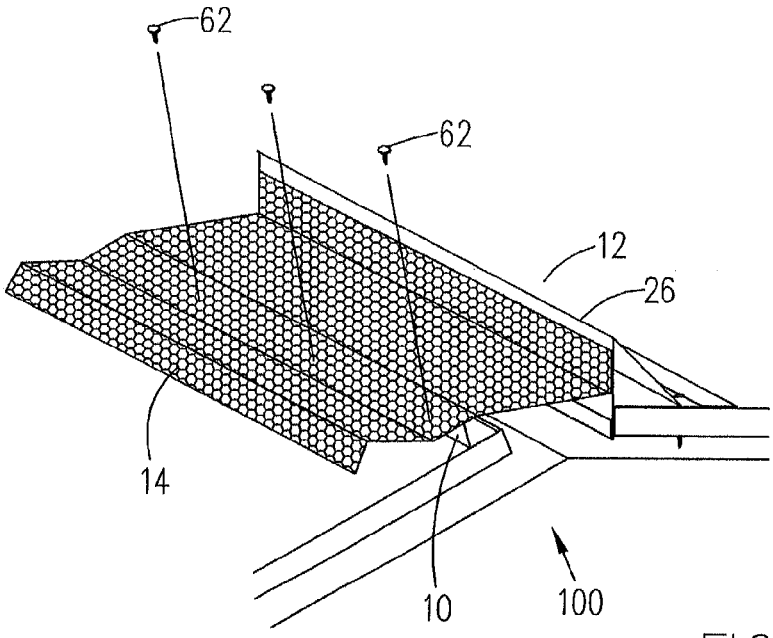
FIG. 6 is a perspective view of a perforated support positioned on first and second support brackets, before attachment to the first support bracket with a plurality of fasteners of a customizable roof ventilator in accordance with the present invention.
Figure 7:
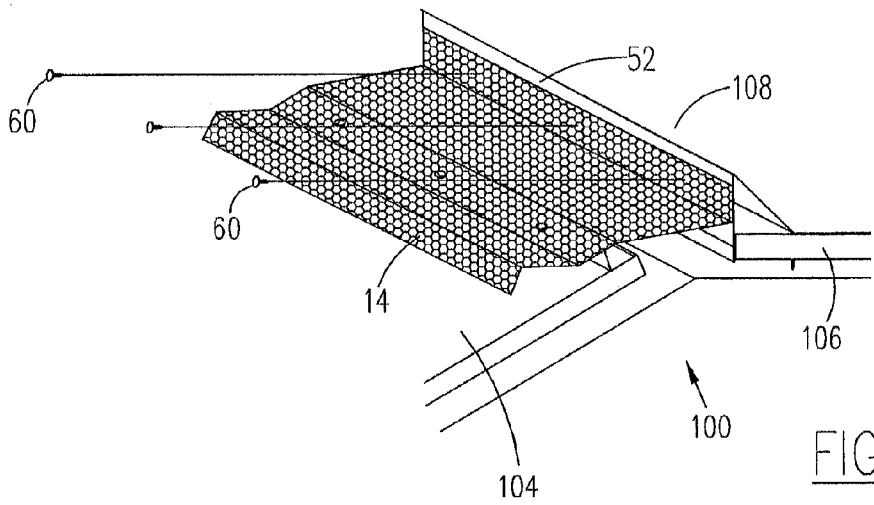
FIG. 7 is a perspective view of a perforated support positioned on first and second support brackets, before attachment to the second support bracket with a plurality of fasteners of a customizable roof ventilator in accordance with the present invention.
Figure 8:
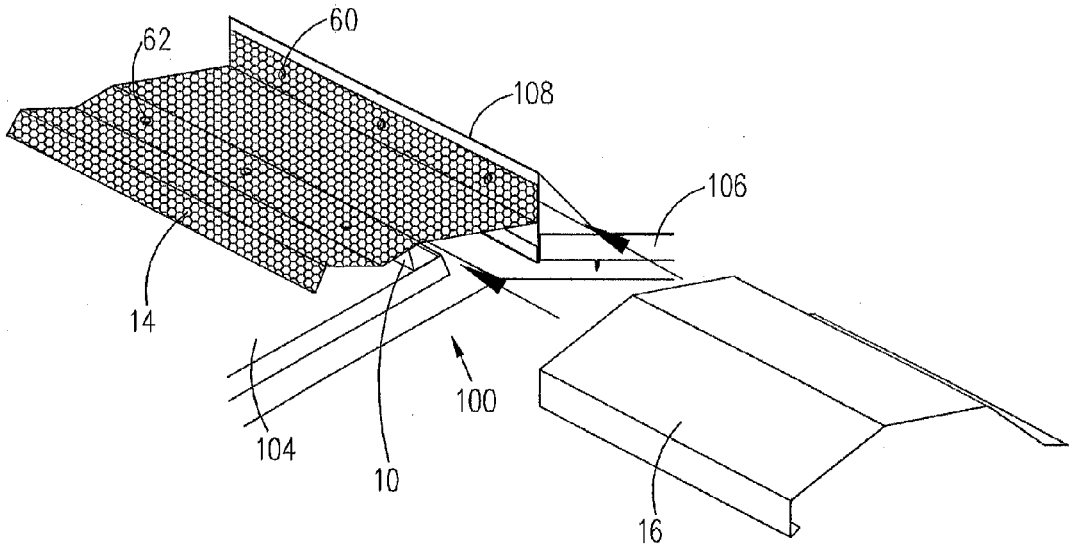
FIG. 8 is a perspective view of a ridge cover adjacent a perforated support of a customizable roof ventilator in accordance with the present invention.
Figure 10:
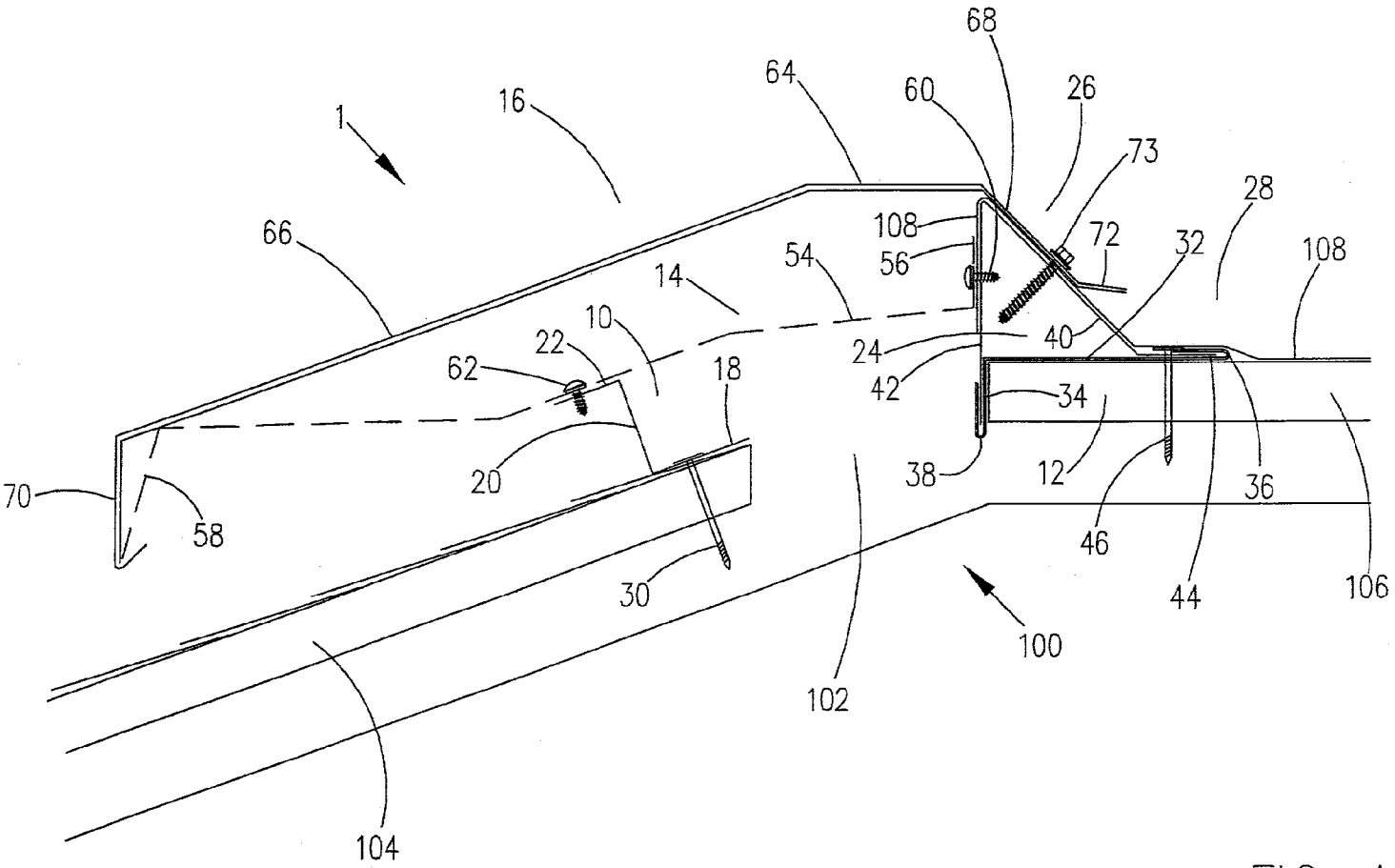
FIG. 10 is an end view of a customizable roof ventilator attached to a roof in accordance with the present invention.

With reference now to the drawings, and particularly to FIG. 10, there is shown an end view of a customizable roof ventilator 1 attached to a roof 100. With reference to FIGS. 1-7, the customizable ridge ventilator 1 includes at least one first support bracket 10, a second support bracket 12, a perforated support 14 and a ridge cover 16. With reference to FIG. 5, the first support bracket 10 has a substantially Z-shaped cross section. The first support bracket 10 includes a roof flange 18, a base member 20 and a perforated support flange 22. The base member 20 is terminated on one end with the roof flange 18 and the perforated support flange 22 on the other end.

The second support bracket 12 includes at least one base member 24 and a support member 26. The roof flange 18 of the first support bracket 10 is attached to a first surface 104, adjacent one side of a ventilation opening 102 with a plurality of fasteners 30. The at least one base member 24 is placed on a second surface 106, adjacent the other side of the ventilation opening 102. With reference to FIG. 10, the base member 24 includes a first leg 32 and a second leg 34. One end of the second leg 34 extends from one end of the first leg 32 at a substantially perpendicular angle. A first hook end 36 is formed on the other end of the first leg 32 by turning over the end thereof. A second hook end 38 is formed on the other end of the second leg 34 by turning over the end thereof.

The support member 26 includes a sloped leg (first support leg) 40, a substantially vertical leg (second support leg) 42 and an attachment leg 44. The attachment leg 44 extends from one end of the sloped leg 40 and the substantially vertical leg 42 extends downward from the other end of the sloped leg 40. The attachment leg 44 of the support member 26 is inserted into the first hook end 36 and the substantially vertical leg 42 is inserted into the second hook end 38. A plurality of fasteners 46 are used to secure the attachment leg 44 of the support member 26 and the first leg 32 of the at least one base member 24 to the second surface 106.

A roof membrane 108 of the roof 100 is placed over the base member 24 and support member 26. The roof membrane 108 preferably extends just below the perforated support 14. The perforated support 14 is a formed plate with a plurality of perforated openings. The perforated support 14 preferably includes a cross section with a lengthwise section 54, a support flange 56 and a snap flange 58. The lengthwise section 54 is contoured for attachment to the first support bracket 10. The substantially vertical flange 56 extends upward from one end of the lengthwise section 54 and the snap flange 58 extends downward from the other end of the lengthwise section 54. The substantially vertical flange 56 is secured to the substantially vertical leg 42 of the support member 26 and the roof membrane 108 with a plurality of fasteners 60. Substantially a middle of the lengthwise section 54 is secured to the perforated support flange 22 of the first support bracket 10 with a plurality of fasteners 62.

Figure 9:
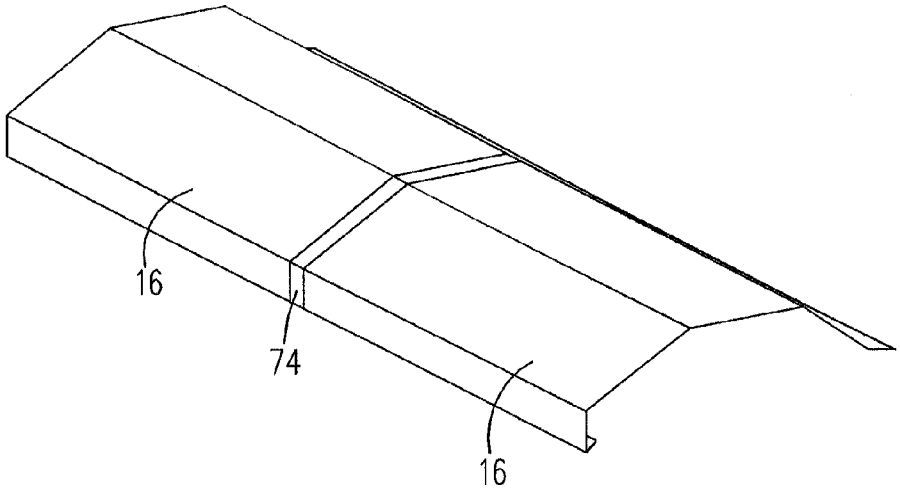
FIG. 9 is a perspective view of two adjacent ridge covers engaged with a cover splice of a customizable roof ventilator in accordance with the present invention.

The ridge cover 16 includes a top portion 64, a sloped leg 66, an attachment leg 68, a snap clip 70 and a drip extension 72. The sloped leg 66 extends from a first side of the top portion 64 and the attachment leg 68 extends from the second side of the top portion 64. The top portion 64 and the sloped leg may be characterized as a lengthwise portion. The sloped leg 66 is terminated with the snap clip 70. The attachment leg 68 is terminated with the drip extension 72. The attachment leg 68 is slid over the roof membrane 108 and the snap clip 70 is slid over the snap flange 58 of the perforated support 14. The attachment leg 68 is secured to the roof membrane 108 and the sloped leg 40 of the support member 26 with a plurality of fasteners 73. With reference to FIG. 9, a cover splice 74 includes a cross section that has the same shape as the ridge cover 16. The cover splice is sized to be received by an inner perimeter of the ridge cover 16. Two adjacent ridge covers 16 are connected to each other with the cover splice 74.

Figure 11:
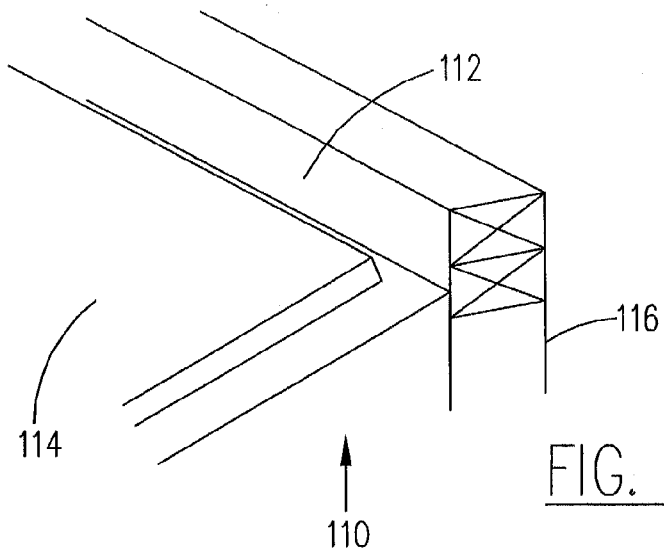
FIG. 11 is a perspective view of a roof with a ventilation opening for attachment of a second embodiment of a customizable roof ventilator in accordance with the present invention.
Figure 12:
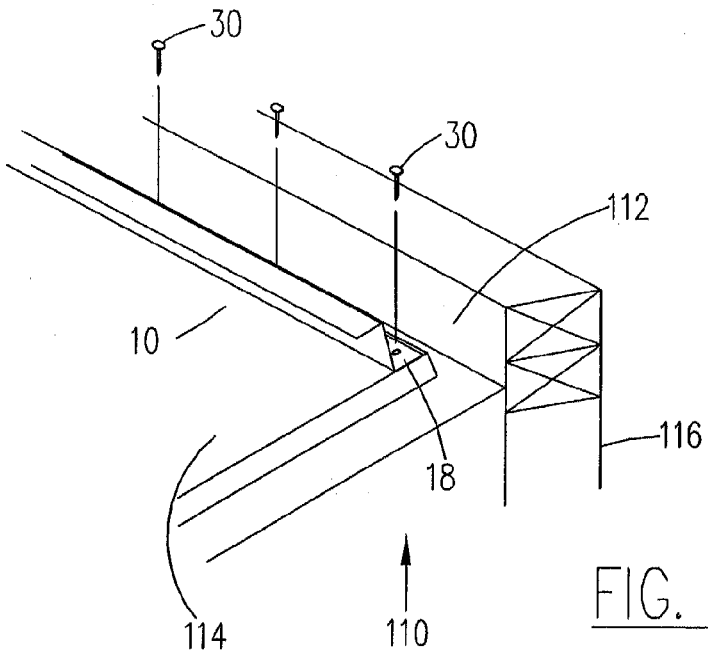
FIG. 12 is a perspective view of a support bracket positioned on a roof, before attachment thereto with a plurality of fasteners of a second embodiment of a customizable roof ventilator in accordance with the present invention.
Figure 17:
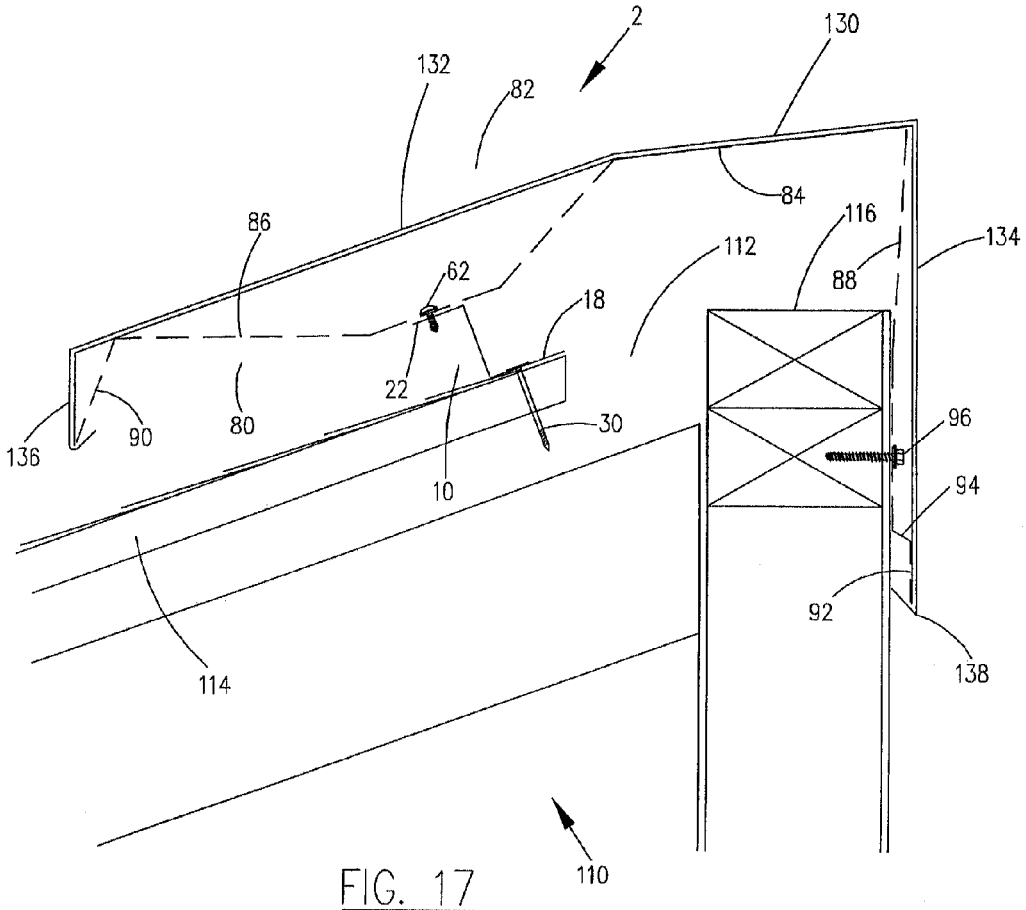
FIG. 17 is an end view of a second embodiment of a customizable roof ventilator attached to a roof in accordance with the present invention.

With reference to FIGS. 11-12 and 17, a second embodiment of the customizable ridge ventilator 2 includes the support bracket 10, a perforated support 80 and a ridge cover 82. The support bracket 10 is attached to a roof surface 114 of a roof 110, adjacent one side of a ventilation opening 112 with a plurality of fasteners 30. The perforated support 80 is a formed plate with a plurality of perforated openings. The perforated support 80 preferably includes a cross section with a top perforated portion 84, a dished perforated portion 86, a substantially vertical perforated portion 88, a first snap flange 90 and a second snap flange 92. The top perforated portion 84 and the dished perforated portion 86 may be characterized as a lengthwise perforated portion. The dished perforated portion 86 extends from one side of the top perforated portion 84 and the substantially vertical perforated portion 88 extends downward from the other side of the top perforated portion 84.

Figure 13:
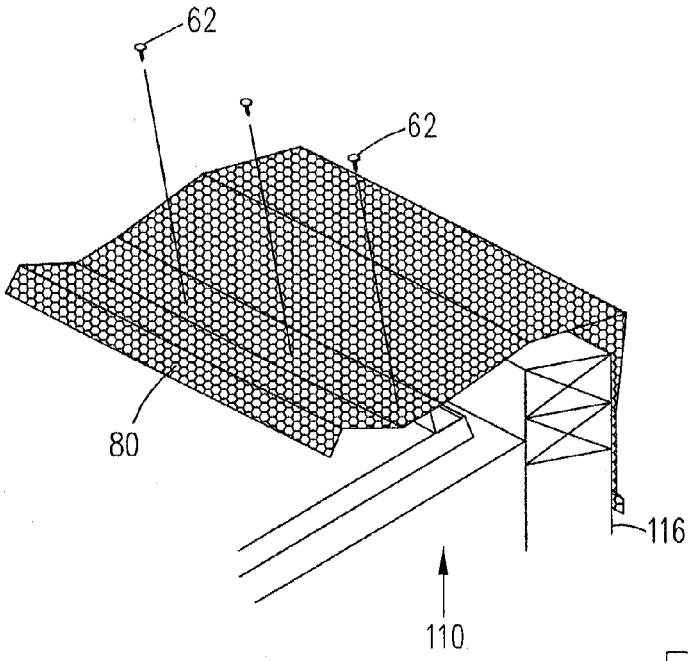
FIG. 13 is a perspective view of a perforated support positioned on a support bracket and against a vertical surface before attachment to the support bracket with a plurality of fasteners of a second embodiment of a customizable roof ventilator in accordance with the present invention.
Figure 14:
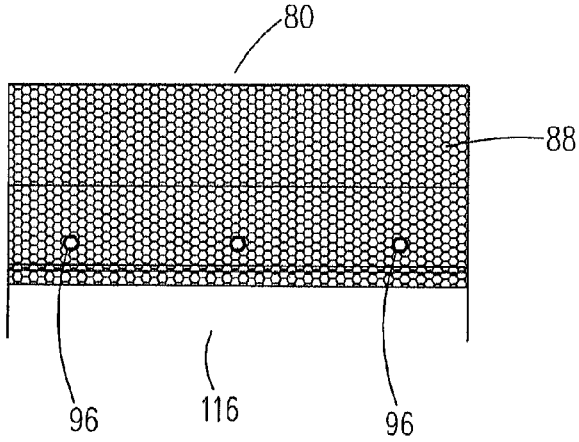
FIG. 14 is an front view of a perforated support positioned against a vertical surface of a second embodiment of a customizable roof ventilator in accordance with the present invention.

The dished perforated portion 86 is terminated with the first snap flange 90 and the substantially vertical perforated portion 88 is terminated with the second snap flange 92. The second snap flange 92 is offset from the substantially vertical perforated portion 88 with an offset portion 94. The dished perforated portion 86 is contoured for attachment to the first support bracket 10. With reference to FIG. 13, the dished perforated portion 86 is attached to a perforated support flange 22 of the first support bracket 10 with a plurality of fasteners 62. One side of a vertical wall 116 forms the other side of the ventilation opening 112. With reference to FIG. 14, the substantially vertical perforated portion 88 is attached to the other side of the vertical wall 116 with a plurality of fasteners 96.

Figure 15:
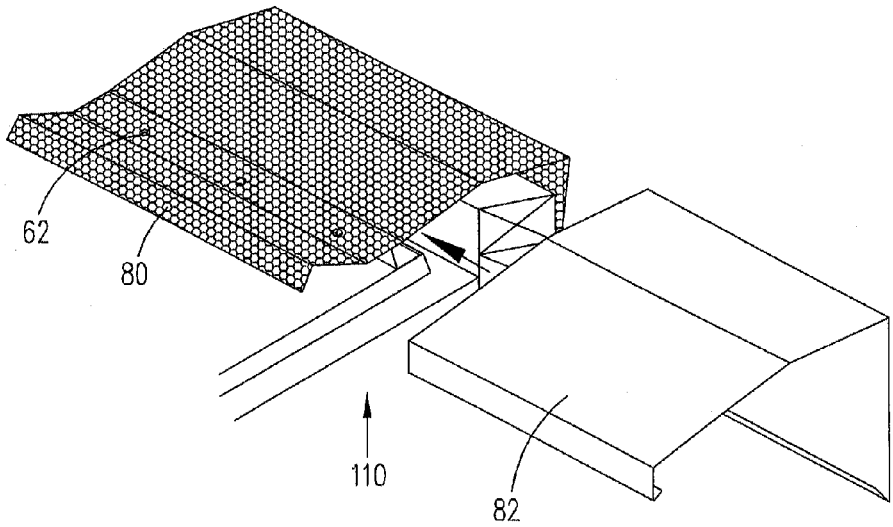
FIG. 15 is a perspective view of a ridge cover adjacent a perforated support of a second embodiment of a customizable roof ventilator in accordance with the present invention.
Figure 16:
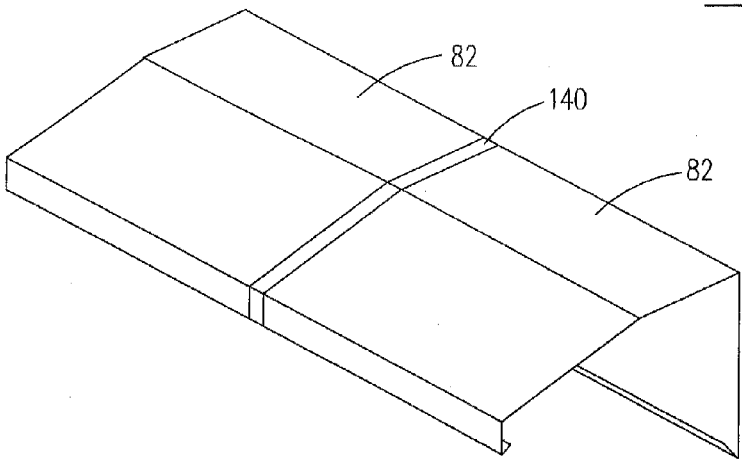
FIG. 16 is a perspective view of two adjacent ridge covers engaged with a cover splice of a customizable roof ventilator in accordance with the present invention.

The ridge cover 82 includes a top portion 130, a sloped portion 132, a substantially vertical portion 134, a first snap clip 136 and a second snap clip 138. The sloped portion 132 extends from one side of the top portion 130 and the substantially vertical portion 134 extends from the other side of the top portion 130. The sloped portion 132 is terminated with the first snap clip 136 and the substantially vertical portion 134 is terminated with the second snap clip 138. The top portion 130 and the sloped portion 132 may be characterized as a lengthwise portion. With reference to FIG. 15, the first snap clip 136 is slid over the first snap flange 90 and the second snap clip 138 is slid over the second snap flange 92. With reference to FIG. 16, a cover splice 140 includes a cross section that has the same shape as the ridge cover 82. The cover splice 140 is sized to be received by an inner perimeter of the ridge cover 82. Two adjacent ridge covers 82 are connected to each other with the cover splice 140.

Figure 18:
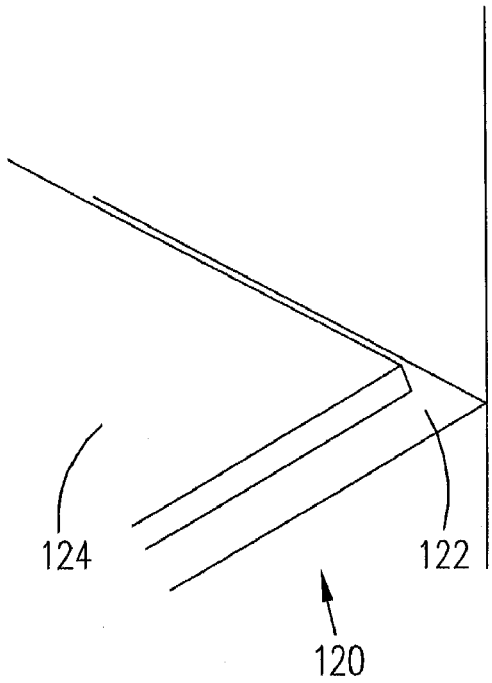
FIG. 18 is a perspective view of a roof with a ventilation opening for attachment of a third embodiment of a customizable roof ventilator in accordance with the present invention.
Figure 19:
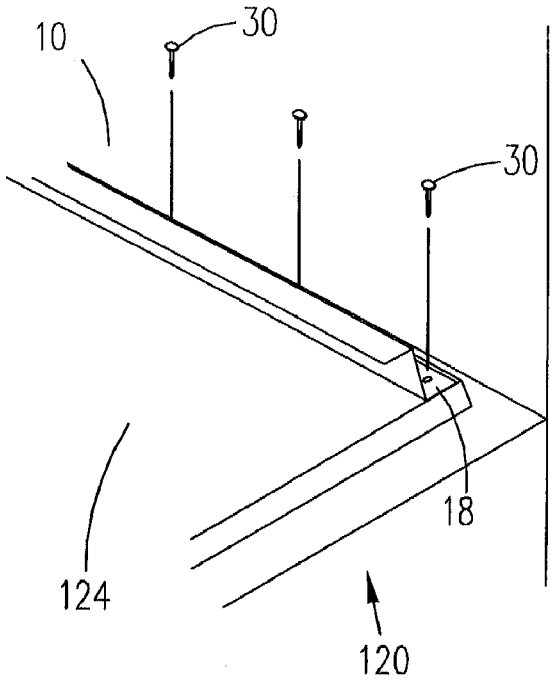
FIG. 19 is a perspective view of a support bracket positioned on a roof, before attachment thereto with a plurality of fasteners of a third embodiment of a customizable roof ventilator in accordance with the present invention.
Figure 20:
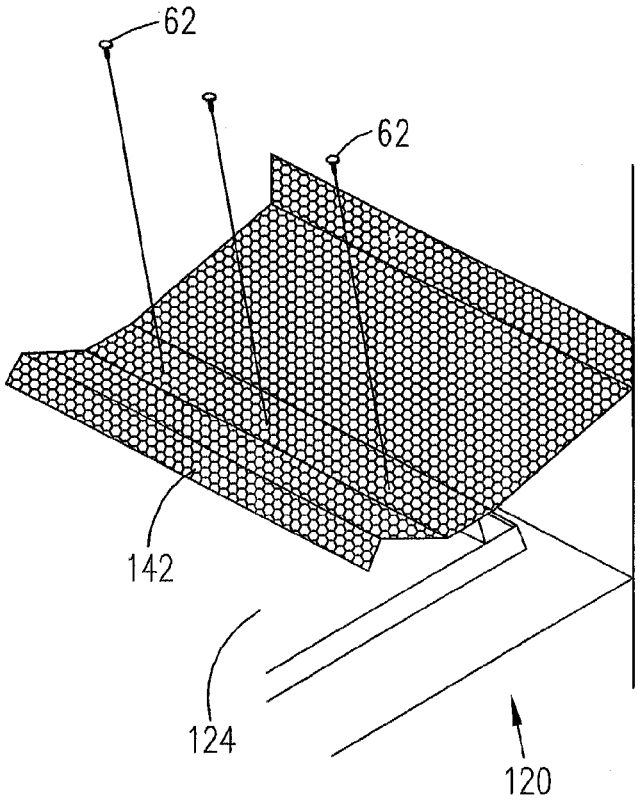
FIG. 20 is a perspective view of a perforated support positioned on a support bracket and against a vertical surface before attachment to the support bracket with a plurality of fasteners of a third embodiment of a customizable roof ventilator in accordance with the present invention.
Figure 23:
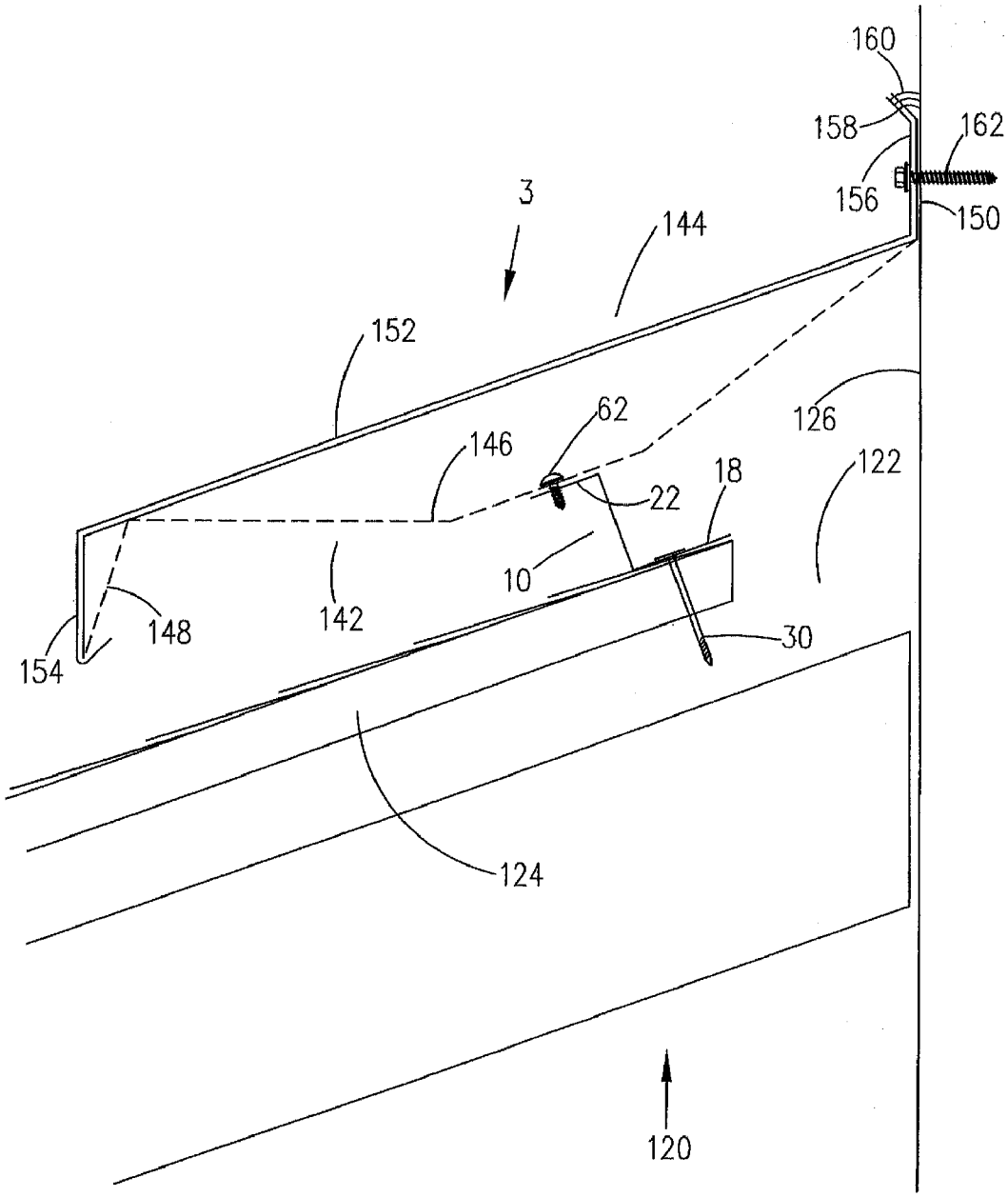
FIG. 23 is an end view of a third embodiment of a customizable roof ventilator attached to a roof in accordance with the present invention.

With reference to FIGS. 18-19 and 23, a third embodiment of the customizable ridge ventilator 3 includes the support bracket 10, a perforated support 142 and a ridge cover 144. The support bracket 10 is attached to a roof surface 124 of a roof 120, adjacent one side of a ventilation opening 122 with a plurality of fasteners 30. The perforated support 142 is a formed plate that is perforated with a plurality of openings. The perforated support 142 preferably includes a cross section with a dished portion 146, a snap flange 148 and a perforated attachment flange 150. One end of the dished portion 146 is terminated with the snap flange 148 and the other end of dished portion 146 is terminated with the perforated attachment flange 150. The dished portion 146 is contoured for attachment to the first support bracket 10. With reference to FIG. 20, the perforated support 142 is attached to the support bracket 10 with a plurality of fasteners 62.

Figure 21:
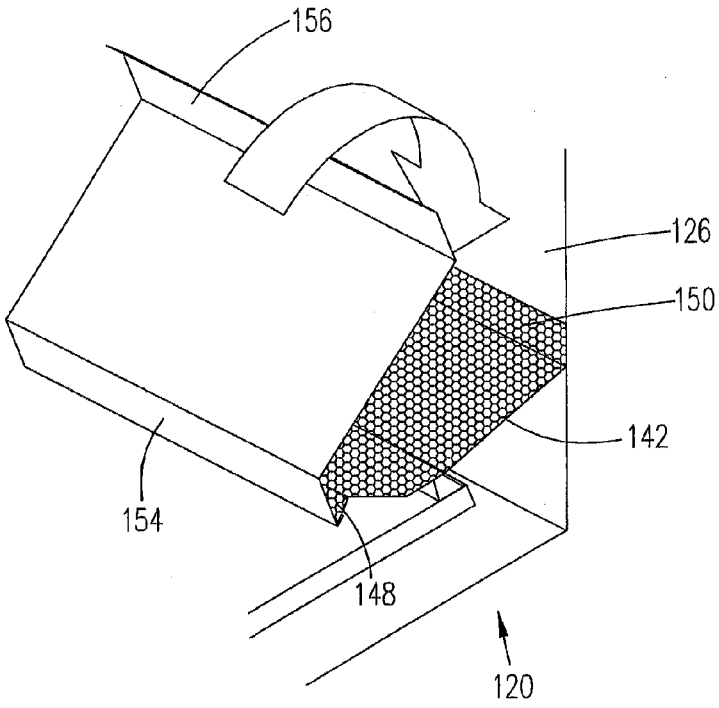
FIG. 21 is a perspective view of a ridge cover adjacent a perforated support of a third embodiment of a customizable roof ventilator in accordance with the present invention.
Figure 22:
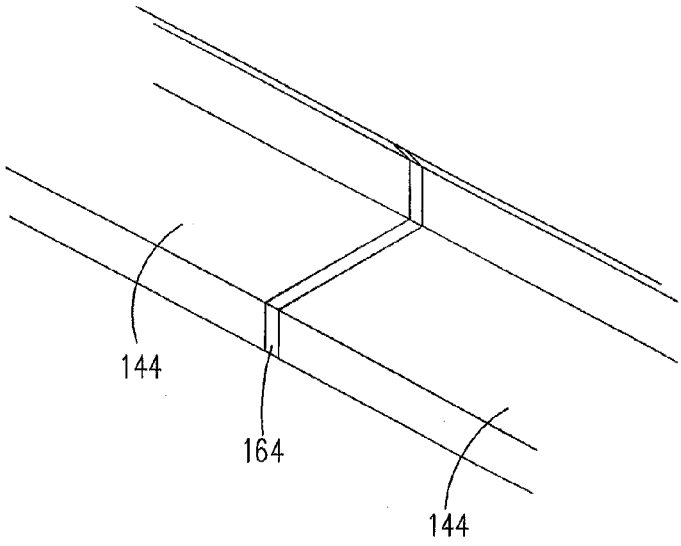
FIG. 22 is a perspective view of two adjacent ridge covers engaged with a cover splice of a customizable roof ventilator in accordance with the present invention.

The ridge cover 144 preferably includes a cross section with a sloped top portion 152, a snap clip 154 and an attachment flange 156. One end of the top portion 152 is terminated with the snap clip 154 and the other end of sloped top portion 152 is terminated with the attachment flange 156 extending in a direction opposite that of the snap clip 154. With reference to FIG. 21, the snap clip 154 is slid over the snap flange 148 of the perforated support 142 and the perforated support 142 is rotated against the perforated attachment flange 150 and a wall surface 126. The attachment flange 156 is secured to the wall surface 126 with a plurality of fasteners 162. A caulk lip 158 preferably extends from the attachment flange 156 for retaining a quantity of caulk 160. The quantity of caulk 160 seals the ridge cover 144 to the wall surface 126. With reference to FIG. 22, a cover splice 164 includes a cross section that has substantially the same shape as the ridge cover 144. The cover splice 164 is sized to be received by an inner perimeter of the ridge cover 144. Two adjacent ridge covers 144 are connected to each other with the cover splice 164.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A ridge ventilator in combination with a roof system comprising:

a first support bracket attached to the roof; and a perforated support having a first end and a second end, a middle portion of said perforated support is covered by a portion of said first support bracket that prevents air flow through said middle portion; and a ridge cover having a snap clip formed on one end and an attachment flange formed on the other end, said first end of said perforated support being retained by said snap clip, said second end of said perforated support and said attachment flange being directly secured to a wall, a flow cavity is formed between said perforated support and said ridge cover, each end of said perforated support is in contact with said ridge cover, air flow enters one end of said perforated support into said flow cavity and exits through the other end of said perforated support.

2. The ridge ventilator in combination with a roof system of claim 1, further comprising:

said first support bracket including a roof flange, a base member and a perforated support flange, said base member being terminated with said roof flange on one end and with said perforated support flange on the other end.

3. The ridge ventilator in combination with a roof system of claim 1 wherein:

said ridge cover being sloped relative to the wall.

4. The ridge ventilator in combination with a roof system of claim 1, further comprising:

a caulk lip extending from said attachment flange for retaining a quantity of caulk.

5. The ridge ventilator in combination with a roof system of claim 1, further comprising:

a first snap flange being formed on a first end of said perforated support, a perforated attachment flange being formed on a second end of said perforated support.

6. A ridge ventilator in combination with a roof system, comprising:

said roof system having a roof and a wall, said wall being adjacent to said roof;

a first support bracket attached to the roof; and a perforated support having a first end and a second end, a middle portion of said perforated support is covered by a portion of said first support bracket that prevents air flow through said middle portion, said first support bracket supports said middle portion of said perforated support, said perforated support having a dished contour; and a ridge cover having a snap clip formed on one end and an attachment flange formed on the other end, said first end of said perforated support being retained by said snap clip, said second end of said perforated support and said attachment flange being directly secured to the wall, a flow cavity is formed between said perforated support and said ridge cover, each end of said perforated support is in contact with said ridge cover, air flow enters one end of said perforated support into said flow cavity and exits through the other end of said perforated support.

7. The ridge ventilator in combination with a roof system of claim 6, further comprising:

said first support bracket including a roof flange, a base member and a perforated support flange, said base member being terminated with said roof flange on one end and with said perforated support flange on the other end.

8. The ridge ventilator in combination with a roof system of claim 6 wherein:

said ridge cover being sloped relative to the wall.

9. The ridge ventilator in combination with a roof system of claim 6 wherein:

a caulk lip extending from said attachment flange for retaining a quantity of caulk.

10. The ridge ventilator in combination with a roof system of claim 6 wherein:

a first snap flange being formed on a first end of said perforated support, a perforated attachment flange being formed on a second end of said perforated support.

* * * * *